US009151026B2

(12) United States Patent
Wildfang

(10) Patent No.: US 9,151,026 B2
(45) Date of Patent: Oct. 6, 2015

(54) SANITARY OUTLET FITTING WITH VANDAL-PROOF OUTLET NOZZLE RECESSED IN THE ACCOMMODATING OPENING OF THE FITTING

(75) Inventor: Fabian Wildfang, Badenweiler (DE)

(73) Assignee: NEOPERL GMBH, Mullheim (DE)

( * ) Notice: Subject to any disclaimer, the term of this patent is extended or adjusted under 35 U.S.C. 154(b) by 1674 days.

(21) Appl. No.: 11/908,046

(22) PCT Filed: Feb. 28, 2006

(86) PCT No.: PCT/EP2006/001838

§ 371 (c)(1),
(2), (4) Date: Sep. 7, 2007

(87) PCT Pub. No.: WO2006/094680

PCT Pub. Date: Sep. 14, 2006

(65) Prior Publication Data

US 2009/0007977 A1 Jan. 8, 2009

(30) Foreign Application Priority Data

Mar. 9, 2005 (DE) ..... 10 2005 011 194

(51) Int. Cl.
*E03C 1/08* (2006.01)

(52) U.S. Cl.
CPC ..... *E03C 1/08* (2013.01); *Y10T 137/9464* (2015.04)

(58) Field of Classification Search
USPC ..... 239/428.5, 431, 432, 452, 533.13; 261/76, 78.1
See application file for complete search history.

(56) References Cited

U.S. PATENT DOCUMENTS

| | | | | | |
|---|---|---|---|---|---|
| 2,989,249 | A | * | 6/1961 | Richter | 239/427 |
| 3,014,667 | A | * | 12/1961 | McLean et al. | 239/428.5 |
| 3,298,614 | A | * | 1/1967 | Aghnides | 239/428.5 |
| 3,827,636 | A | * | 8/1974 | Parkison et al. | 239/428.5 |
| 4,364,523 | A | | 12/1982 | Parkison et al. | |

(Continued)

FOREIGN PATENT DOCUMENTS

| | | |
|---|---|---|
| CH | 380042 | 7/1964 |
| DE | 1658154 | 8/1970 |
| DE | 202005003910 | 6/2005 |

(Continued)

*Primary Examiner* — Justin Jonaitis
(74) *Attorney, Agent, or Firm* — Volpe and Koenig, P.C.

(57) ABSTRACT

A sanitary outlet fitting (1) having a water outlet (2) with an internally threaded receiving opening (3) is provided, having a sleeve-shaped outlet nozzle (7) which has an external thread on its periphery which can be screwed in a releasable manner into the internal thread of the receiving opening, and having a jet regulator or similar sanitary insert part that is retained in the sleeve interior of the outlet nozzle. The outlet nozzle (7) includes on its outlet end side, at least one slot, a profiling or a similar tool attachment surface, and a ring element (5) is mounted in a freely rotatable manner at the outlet end region of the outlet nozzle (7) that encloses the outlet nozzle and serves for vandal proofing. The outlet fitting (1) according to the invention is characterized in that the internal diameter (d1) of the receiving opening (3) at the outer end region of the fitting corresponds, at least approximately, to the external diameter (d2) of the outlet nozzle (7) in the region of the freely rotatably mounted ring element (5), and the axial depth (l1) of the receiving opening (3) is adapted to the axial extension (l2) of the outlet nozzle (7) such that the outlet nozzle (7) only has part of the longitudinal extension of the ring element (5) projecting beyond the receiving opening (3).

4 Claims, 4 Drawing Sheets

(56) References Cited

U.S. PATENT DOCUMENTS

| | | | | |
|---|---|---|---|---|
| 4,534,514 | A * | 8/1985 | Aghnides | 239/428.5 |
| 6,971,591 | B2 * | 12/2005 | Fleischmann | 239/428.5 |

FOREIGN PATENT DOCUMENTS

| | | |
|---|---|---|
| DE | 102004008594 | 9/2005 |
| WO | 2004038112 | 5/2004 |

* cited by examiner

SANITARY OUTLET FITTING WITH VANDAL-PROOF OUTLET NOZZLE RECESSED IN THE ACCOMMODATING OPENING OF THE FITTING

BACKGROUND

The invention relates to a sanitary outlet fitting with a water outlet, provided with an receiving opening having an internal thread, with a sleeve-like outlet nozzle carrying at the perimeter an external thread that can be screwed into the internal thread of the receiving opening in a detachable manner, and with a jet regulator or a similar sanitary insert part held inside the sleeve of the outlet nozzle with the outlet nozzle carrying at the face of its outlet end at least a slot, a profiling, or a similar tool attachment surface and with a ring element being supported in a freely rotational manner at the outlet end region of the outlet nozzle, encompassing the outlet nozzle and serving as a vandalism protection.

The jet regulators inserted in outlet fittings form the out flowing water to a homogenous, bubbling-soft water jet. In order to allow fastening such a jet regulator or at least another sanitary insert part to such a sanitary outlet fittings, some sanitary outlet fittings with a water outlet are already known, which include outlet openings having an internal thread, and a sleeve-like outlet nozzle, which circumferentially carries an external thread that can be screwed in a detachable manner into the internal thread of the outlet opening, with the jet regulator or a similar sanitary insert part being held inside the sleeve of the outlet nozzle. Frequently there is the problem, though, that the jet regulator or similar sanitary insert part, held via a sleeve-shaped outlet nozzle to a sanitary outlet fitting, is screwed out of the outlet fitting and stolen by unauthorized persons, in particular when it is used in the public sector, for example in hotels, restaurants, or athletic facilities.

In order to prevent such theft, sanitary outlet fittings of the type mentioned at the outset are known, with their outlet nozzle carrying a slot, a profiling, or a similar tool attachment surface at the face of its outlet end, with a ring element encompassing the outlet nozzle supported in a freely rotational manner at the outlet end region of the outlet nozzle, serving as a vandalism protection. In this manner, the outlet nozzle and the sanitary insert part located therein cannot be screwed out of the sanitary outlet fitting by unauthorized persons, because when turning the ring element, the outlet nozzle itself does not rotate. In order to assemble or disassemble the outlet nozzle as well as the sanitary insert part located therein, a special tool is necessary, which is inserted into the outlet nozzle at the downstream end and thus allows the external thread provided at the outlet nozzle to be screwed in or screwed out of the internal thread of the water outlet fitting.

In these outlet fittings of prior art it is disadvantageous, though, that the ring element freely rotational at the outlet nozzle has an additional, relatively large diameter so that the ring element protrudes entirely beyond the water outlet of the sanitary outlet fitting and the outlet fitting thus has an unappealing appearance. Additionally, in outlet fittings with a curved water outlet a sectionally ugly gap develops between the water outlet of the sanitary outlet fitting, on the one hand, and the ring element of the outlet nozzle, on the other hand, so that the cleaning in this area is also more difficult. Additionally, based on its relatively large diameter in particular in curved outlet fittings, the freely rotational ring element can abut the outlet fitting such that the outlet nozzle cannot entirely be screwed into internal thread of the outlet fitting and the ring seal provided at the threaded face of the jet regulator cannot fulfill its sealing function.

From U.S. Pat. No. 2,989,249 A, a sanitary outlet fitting with a water outlet is known, that includes a receiving opening with internal threads. This known outlet fitting has a sleeve shaped outlet nozzle that has external threads on its periphery that engage the internal threads of the receiving opening. In the inside of the sleeve is a flow regulator or similar or similar sanitary insert part. The outlet nozzle carries on its outlet facing side through interchanging upward and downward projections, a crown shaped tool engageable surface. A longitudinally fixed, but freely rotatable about the longitudinal axis of the outlet nozzle, ring element is located on the thread free section of the outlet nozzle that extends from the outlet mouth that does not have a gripping surface to prevent unauthorized unthreading of the outlet nozzle. Similar protection from unauthorized manipulation of sanitary outlet fixtures is also provided in U.S. Pat. No. 4,364,523 as well as U.S. Pat. No. 3,827,636.

For these previously known sanitary outlet fixtures, the freely rotatable ring element that extends from the water outlet on an extended area of the outlet nozzle disrupts the aesthetic appearance of the sanitary outlet fixture.

SUMMARY

Therefore, the object is to provide a sanitary outlet fitting of the type mentioned above, in which the sanitary insert part can be even better protected from theft and can be better integrated into the outlet of the fixture in order not to restrict the design freedom when constructing and producing such sanitary outlet fittings and here to be aesthetically less disruptive.

This object is attained according to the invention particularly in that the internal diameter of the receiving opening at its external end section is at least approximately equivalent to the external diameter of the outlet nozzle in the area of its ring element supported in a freely rotational manner, and that the axial depth of the receiving opening is adjusted to an axial extension of the outlet nozzle such that the outlet nozzle only protrudes beyond the receiving opening with a partial section of the longitudinal extension of its ring element, and the external diameter of the ring element is approximately equivalent to or smaller than the external diameter of the outlet nozzle in the threaded section thereof, and that for this purpose a partial section of the outlet nozzle which carries the annual element in a downstream location has a reduced external diameter in reference to the threaded section.

The outlet nozzle of the outlet fitting according to the invention is mounted to the water outlet such that it cannot be unthreaded manually or by a tool engaging at the outside. Through these measures, it is neither possible to attach a tool, for example a pair of pliers, at the perimeter of the outlet nozzle nor to manually unthread the outlet nozzle, thus a reliable theft protection is given. Additionally, the insert part arranged practically inserted up to its ring element in an optically non-disruptive manner with regard to its appearance and there is practically no access possible for damage. Due to the fact that therefore a partial section of the ring element freely held in a rotational manner at the outlet nozzle protrudes the outlet opening of the sanitary outlet fitting, even in case of a curved outlet fitting, an ugly gap is avoided between the water outlet, on the one hand, and the ring element of the outlet nozzle, on the other hand.

In that the ring element carrying out flow side region of the outlet nozzle has a reduced diameter in comparison to the to the threaded region, the outer diameter in the threaded region is also reduced so that the outer diameter of the ring element is about the same as or smaller than the outer diameter of the outlet nozzle in the threaded region. The internal diameter of the outlet opening can therefore have a similar remaining internal diameter so the thickness of the ring element through the back projection of the outlet nozzle where it engages. The outlet fixture according to the invention permits engagement of the outlet nozzle in the outlet opening of the water outlet up to the ring element itself even when the receiving opening of the outlet fitting has an approximately constant open internal diameter over its axial longitudinal extension, even when only a relatively small annular gap or free space remains between the open internal perimeter of the receiving opening, on the one hand, and the outlet nozzle and/or its ring element, on the other hand.

Even if it were possible to attach a tool at the slight protrusion of the ring element beyond the outlet opening of the sanitary outlet fitting, the outlet nozzle itself could still not be unthreaded and removed because only the freely rotational ring element would be moved by the tool.

It can be advantageous for the receiving opening of the water outlet to be provided with an internal threaded section and a receiving section for the ring element of the outlet nozzle, to expand from the threaded section towards the external inserted end. By such a gradual receiving opening, even conventional jet regulators, flow regulators, flow limiters, back-flow preventors, or other sanitary insert parts can be used for the outlet fitting according to the invention.

In order to allow even conventional jet regulators or similar sanitary insert parts to be fastened at the outlet fitting according to the invention, it is advantageous if the external diameter of the sanitary insert part has a threaded section with normal standard measures for outlet fittings.

BRIEF DESCRIPTION OF THE DRAWINGS

Additional advantageous embodiments are discernible from the claims as well as drawings described in the following:

Shown are.

DETAILED DESCRIPTION OF THE PREFERRED EMBODIMENTS

Figure 1:
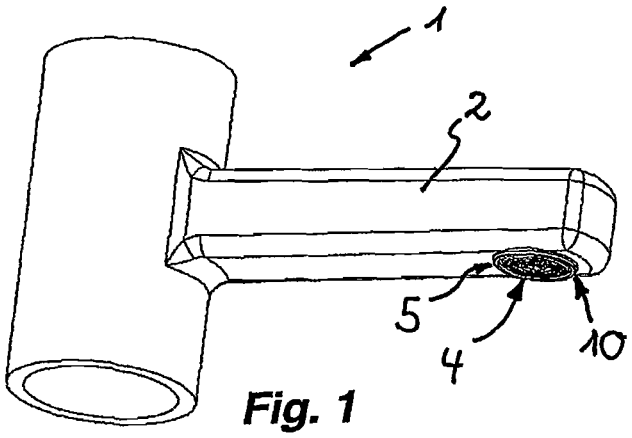
FIG. 1 a perspective view of an outlet fitting according to the invention.
Figure 2:
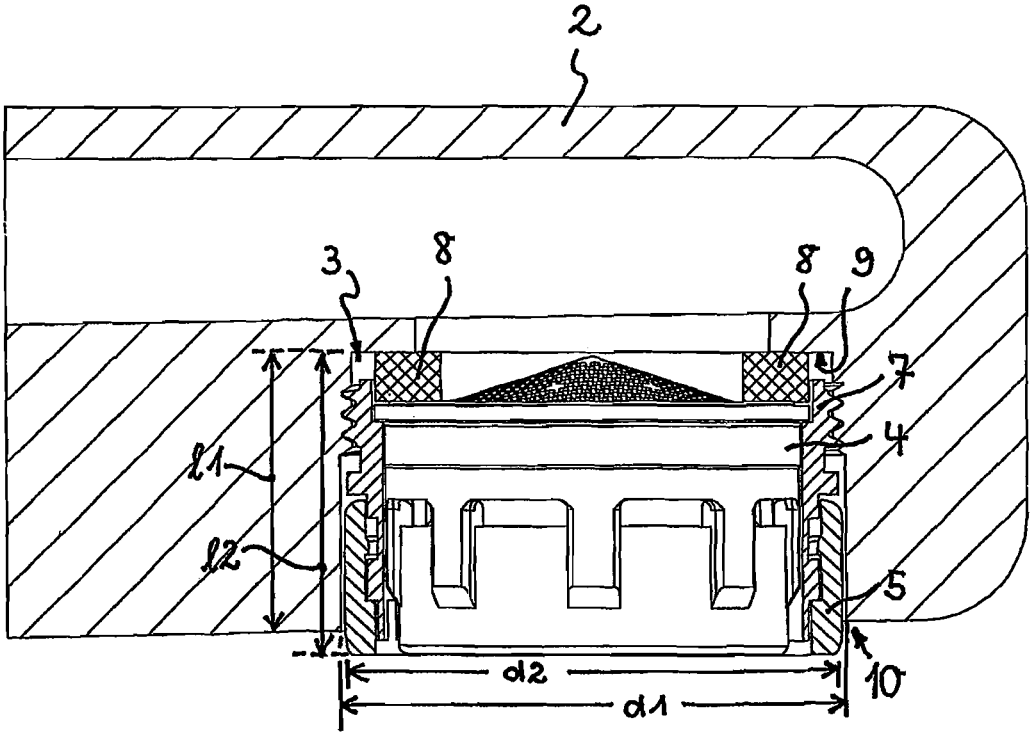
FIG. 2 a cross-sectional view of the outlet end of the outlet fitting of FIG. 1, FIG. 3 a perspective view of an outlet fitting according to the invention with a curved water outlet, FIG. 4 a cross-sectional view of the outlet end of the outlet fitting of FIG. 3, FIG. 5 a view of an outlet nozzle intended for the outlet fittings in FIGS. 1 through 4 receiving a jet regulator and the tool necessary to assembly and disassemble the outlet nozzle at the outlet fitting, FIG. 6 a view of the outlet nozzle of FIG. 5 with a tool engaging the tool attachment surfaces of the outlet nozzle, FIG. 7 a view of the outlet nozzle shown here without an inserted jet regulator in a facial view at the downstream side, and FIG. 8 a view of the outlet nozzle of FIG. 7 in a perspective representation, with the upstream thread section of the outlet nozzle being well discernible, on the one hand, and on the other hand the ring element supported rotational at the downstream end section of the perimeter of the outlet nozzle.

In FIGS. 1 and 2 and/or 3 and 4 two embodiments of a sanitary outlet fitting 1 are shown. The sanitary outlet fitting 1 is provided with a water outlet 2 having an outlet opening 3, carrying an internal thread. A sleeve-shaped outlet nozzle 7 is allocated to the sanitary outlet fitting 1, having an external thread on its perimeter that can detachably be screwed into the internal thread of the receiving opening 3. Inside the sleeve of the sleeve-shaped outlet nozzle 7 a sanitary insert part 4 is held, embodied here as a jet regulator. For this purpose, the outlet nozzle 7 is provided at its internal perimeter with an annular stop 21, upon which in the operational position a protruding perimeter of an annular flange 22 rests at the inlet end region of the sanitary insert part 4.

As discernible from FIGS. 5 through 8, the outlet nozzle 7 is provided at its end face of the outlet with a tool attachment surface, formed by at least one slot, profiling or tool attachment surface indicated here by two slots 23, open at the end face, arranged at the opposite sides of the outlet nozzle 7. A (special) tool 20 can engage this tool attachment surface shown in greater detail in FIGS. 5 and 6, embodied as an assembly and disassembly key, which allows to screw the external tread provided at the outlet nozzle 7 into and out of the internal thread of the water outlet 2 provided at the outlet fitting 1.

From FIGS. 1 through 8 it is discernible that at the outlet end section of the outlet nozzle 7, a ring element 5 encompassing the outlet nozzle 7 is supported in a freely rotational manner, serving as a vandalism protection. Here, the internal diameter d1 of the receiving opening 3 at the external end section 10 is at least approximately equivalent to the external diameter d2 of the outlet nozzle 7 in the region of its freely rotationally supported ring element 5; the axial depth l1 of the receiving opening 3 is adjusted to the axial extension l2 of the ring element 5 comprising the outlet nozzle 7 so that outlet nozzle 7 protrudes only with a partial section of its longitudinal extension of its ring element 5 beyond the receiving opening 3. This way the outlet nozzle 7 and the sanitary insert part 4 located therein, including its ring element 5 in the water outlet 2 of the outlet fitting 1, is practically arranged inserted, which also improves the aesthetic appearance of the outlet fitting 1.

Due to the internal diameter d1 of the outlet opening 3 and the external diameter d2 of the outlet nozzle 7 being sized such that only a small gap remains between the water outlet 2 and the ring element 5, practically only a special tool 20 provided for the outlet nozzle can be attached to screw in and screw out the outlet nozzle 7.

By the inserted arrangement of the outlet nozzle 7 and its ring elements 5, a manual engagement of the outlet nozzle 7 and/or its ring element 5 is impossible as well as engagement of a pair of pliers or another commercial tool at the external perimeter is impossible due to the small projection of the ring element 5 beyond the water outlet 2.

In addition to the improvement of theft protection, the aesthetic appearance of the sanitary outlet fitting 1 shown here is also considerably improved.

Figure 4:
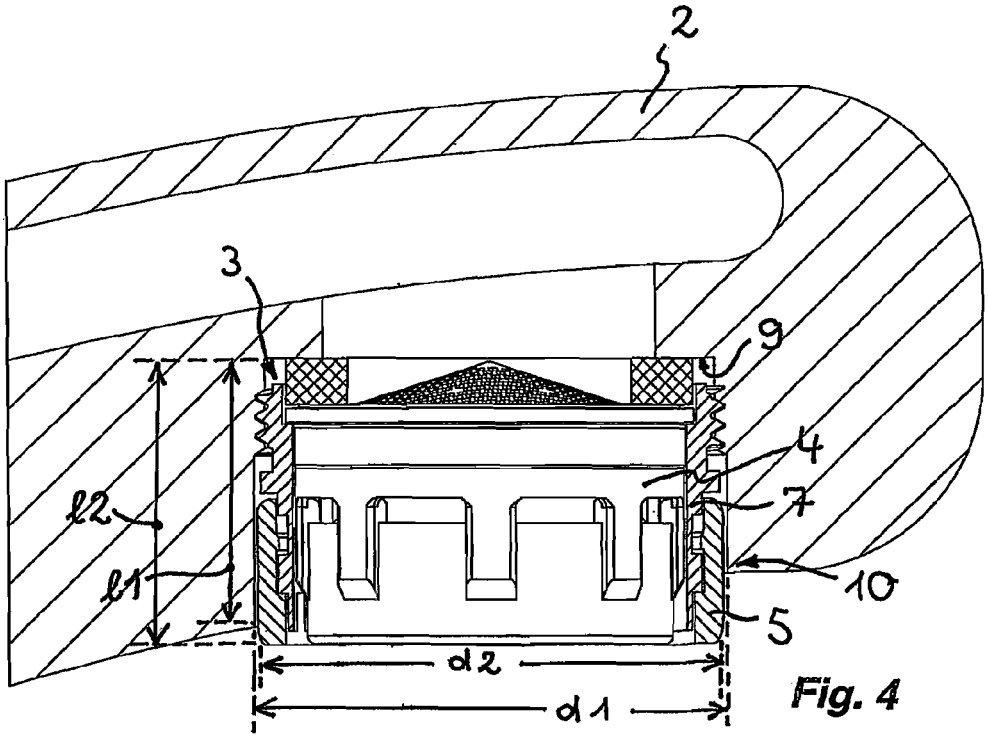

In FIGS. 2 and 4 it is discernible that the external diameter of the ring element is approximately equivalent to the external diameter of the outlet nozzle 7 in its threaded section and that for this purpose the downstream partial section of the outlet nozzle 7 carrying the ring element 5 has a reduced external diameter in reference to its threaded section. In this partial section of the outlet nozzle provided with a reduced external diameter the wall thickness of the outlet nozzle 7 is reduced in reference to jet regulators of prior art. An outlet nozzle 7 with a ring element 5 enlarged in reference to the threaded diameter could be inserted when the receiving opening 3 of the water outlet is appropriately enlarged in the region of the ring element 5 allowing a largely complete acceptance of the outlet nozzle 7 even in this partial section. However, this limits the design freedom during construction and production of the fixture outlet 1.

Figure 3:
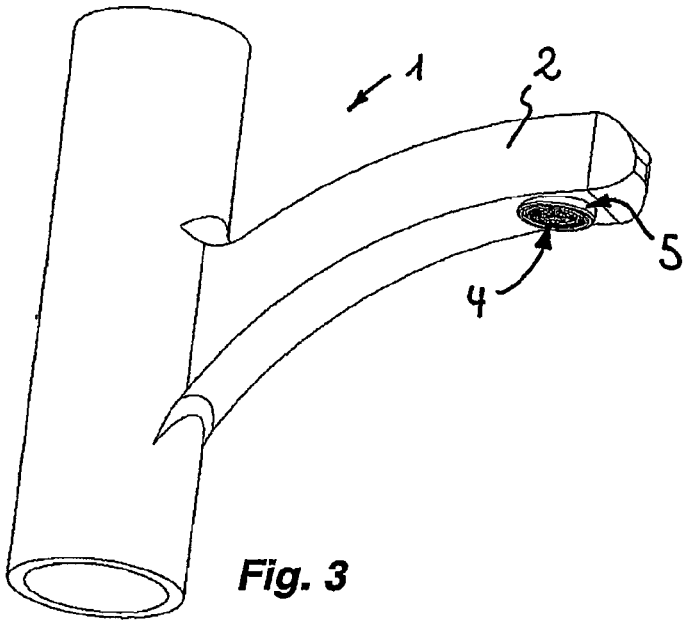

In outlet fittings 1 with a curved water outlet 2, as shown in FIGS. 3 and 4, the outlet nozzle 7 is frequently arranged not perpendicular in reference to the bottom of the water outlet 2. Due to the fact that in this embodiment the outlet nozzle 7 also protrudes beyond the receiving opening 3 with only a partial section of the longitudinal extension of its ring element 5 an otherwise, in case of externally located ring elements 5, remaining annular gap between the water outlet 2 and the ring element 5 is avoided, which disrupts the appearance of the outlet fitting 1 and can aggravate the cleaning in this area and which frequently, in particular in strongly curved outlets, aggravates the tight compression of the annular seal 8 with the internally located facing surface 9 of the receiving opening 3. The theft protection for the sanitary outlet fitting according to FIGS. 3 and 4 also result here by the constructive measure as already described for the outlet fitting 1 according to FIGS. 1 and 2.

Figure 5:
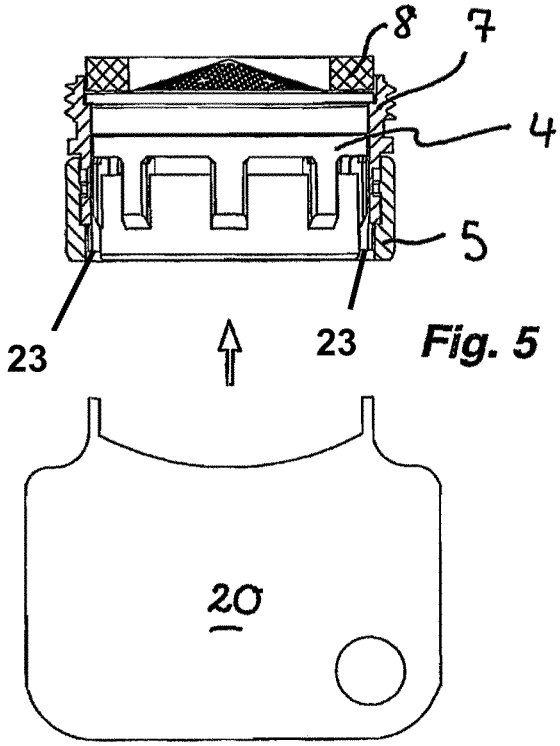
Figure 6:
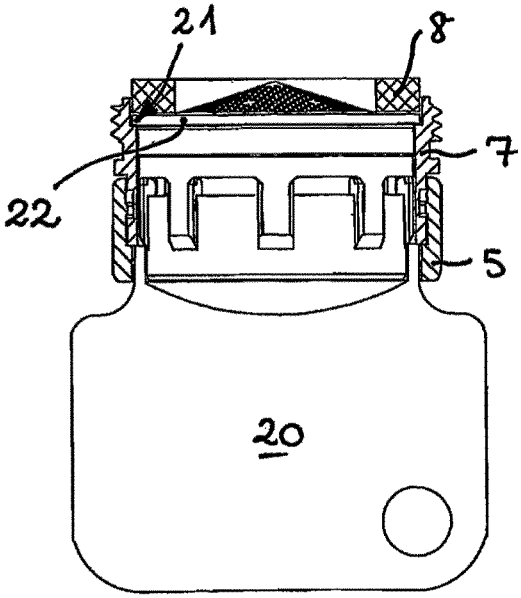
Figure 7:
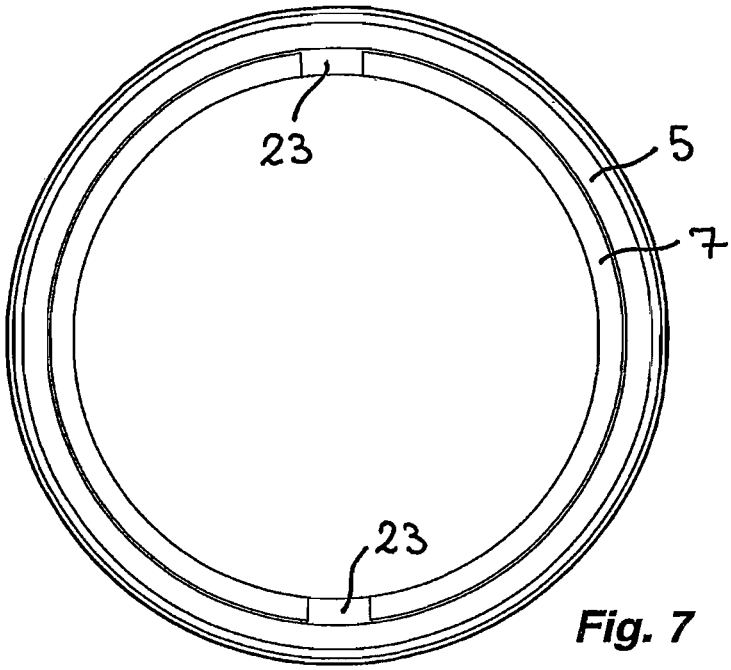
Figure 8:
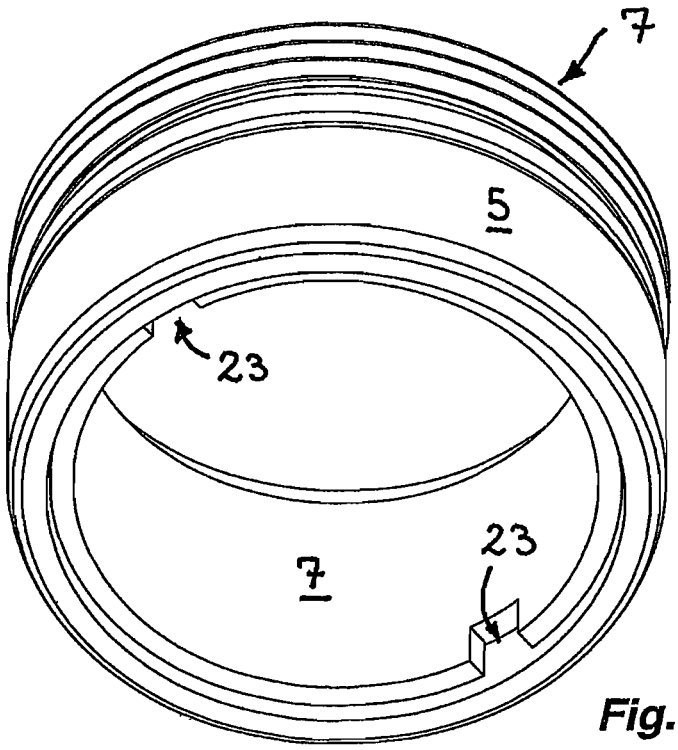

From FIGS. 5 and 6 it is discernible that due to the ring element 5, the outlet nozzle 7 can only be assembled and disassembled with the special tool that can be attached from the downstream side. Screwing the jet regulator 5 manually or via a pair of pliers, engaging the ring element 5, is impossible because only the ring element 5 but not the outlet nozzle 7 is rotated. The continuously rotating ring element 5 and the tool attachment surface provided at the downstream face of the outlet nozzle 7 form an effective protection against vandalism. On the one hand, non-professionals quickly give up when they attempt to disassemble the outlet nozzle 7 and the sanitary insert part 4 located therein, and as the ring element 5, being the only known point accessible to force, rotates continuously, it creates the impression of a continuous "stripped thread". On the other hand, theft protection is also given in that the outlet nozzle 7 and the sanitary insert part 4 located therein can only be disassembled by a special key, which usually is available only to service or professional personnel, with this key being usually unavailable in the environment of amateur users of fixtures in public areas, in particular public areas in danger of theft and vandalism.

The invention claimed is:

1. A sanitary outlet fitting (1) comprising a water outlet (2), provided with an receiving opening (3) having an internal thread, a sleeve-shaped outlet nozzle (7) carrying on a circumference thereof an external thread that can be screwed into the internal thread of the receiving opening (3) in a detachable manner and having a jet regulator (4) or a sanitary insert part, which is held inside a sleeve of the outlet nozzle, with the outlet nozzle (7) including at a face of an outlet end thereof at least a slot, profiling or a tool attachment surface, and a ring element (5) encompassing the outlet nozzle (7) being supported in a freely rotational manner at the outlet end of the outlet nozzle (7), an internal diameter (d1) of the receiving opening (3) is at least approximately equivalent at an external end section thereof to an external diameter (d2) of the outlet nozzle (7) in an area of the ring element (5) that is supported in a freely rotational manner, and an axial depth (l1) of the receiving opening is adjusted to a longitudinal extension (l2) of the outlet nozzle (7) such that the outlet nozzle (7) only protrudes beyond the receiving opening (3) with a partial section of a longitudinal extension of the ring element (5), and an external diameter of the ring element (5) is equivalent to or smaller than the external diameter of the outlet nozzle (7) in the threaded section thereof, and a partial section of the outlet nozzle (7) which carries the ring element (5) in a downstream location has a reduced external diameter in reference to the threaded section.

2. A sanitary outlet fitting according to claim 1, wherein the receiving opening (3) of the water outlet (2) is provided with the internal threaded section and a receiving section for the outlet nozzle (7) or the ring element (5) extending from the threaded section to an external inserted end (10).

3. A sanitary outlet fitting according to claim 1, wherein the external diameter of the outlet nozzle (7) has a normal standard size for outlet fittings in the threaded section.

4. A sanitary outlet fitting according to claim 1, wherein the receiving opening (3) of the outlet fitting (1) has an internal diameter that is approximately constant over an axial longitudinal extension thereof.

* * * * *